US005169222A

United States Patent [19]

Bollore et al.

[11] Patent Number: 5,169,222

[45] Date of Patent: Dec. 8, 1992

[54] DEPOSIT CABINET

[75] Inventors: Loïk Bollore; Patrick Bollore, both of Nantes, France

[73] Assignee: Bollore Protection, Nantes, France

[21] Appl. No.: 684,274

[22] Filed: Apr. 12, 1991

[30] Foreign Application Priority Data

Apr. 19, 1990 [FR] France ..... 90 05349

[51] Int. Cl.[5] ..... H47B 88/00

[52] U.S. Cl. ..... 312/328; 312/319.2; 340/825.3

[58] Field of Search ..... 312/319, 223, 329; 340/825.31, 825.3, 825.35, 825.34, 825.49

[56] References Cited

U.S. PATENT DOCUMENTS 2,301,856 11/1942 Conwell .
3,055,724 9/1962 Mazure ..... 312/319
3,648,241 3/1972 Naito et al. ..... 340/825.31

FOREIGN PATENT DOCUMENTS 0065605 12/1982 European Pat. Off. .
1112814 1/1967 United Kingdom .
2078845 1/1982 United Kingdom .

*Primary Examiner*—Joseph Falk
*Attorney, Agent, or Firm*—Oliff & Berridge

[57] ABSTRACT

The present invention relates to a deposit cabinet comprising a plurality of lockers, each comprising a closing door and an individual means for fastening the various doors in the closed position. According to the invention, each locking means comprises a locking mechanism, with a releasing-open member, and a centralized control system for the lockers, making it possible, on the one hand, to supply a ticket with a personal code and, on the other hand, to open a given locker by calling up in the abovementioned code on a keyboard 29.

6 Claims, 4 Drawing Sheets

DEPOSIT CABINET

BACKGROUND OF THE INVENTION

The present invention relates to a deposit cabinet, in other words a cabinet comprising a plurality of lockers, each comprising a closing door and an individual and reversible locking-up means making it possible to fasten the door in the closed position, which means is controlled solely by the user of said locker; this locking-up means consists, for example, of a lock with its own key, different from the other locks, the key being retained by the user during the deposit period, in other words the period during which an object is stored in the locker which the user has chosen and reserved himself.

DESCRIPTION OF THE PRIOR ART

Deposit cabinets have already been proposed which comprise locks with an information code and controlled by a centralized information system installed in the cabinet, for example.

The document EP-C-0,065,605 discloses a deposit cabinet which comprises a plurality of lockers arranged on top of one another in a column. Each locker comprises a door and a mechanism for locking this door, of the keeper type, which is automatically fastened shut by the closing movement alone of the door; this mechanism is associated with a releasing-open member, with an external control means of the electrical type, of the electromagnetic return means type. This locking mechanism therefore makes it possible to fasten the door shut by the closing movement alone of the latter, under the action of the user, and after this same mechanism has been released open the user must open the door himself in order to have access to the inside of the locker.

Still according to the document EP-C-0,065,605, a centralized system controls all the lockers and incorporates, in addition to the above-described external control means of these lockers, on the one hand indicator lights making it possible to show the free or occupied state of the various lockers, and on the other hand buttons for selecting the latter. This centralized system comprises and communicates with:

- an output peripheral, namely a printer for printing a ticket, and hence the outputting of a variety of data of the alphanumeric type, in particular a unique access code for the locker reserved by the user
- an input peripheral, namely a keyboard which the user touches, and hence the inputting of a datum or data of the alphanumeric type, in particular the access code given to the user
- and a processor loaded with an execution program making it possible to control all the lockers.

This execution program makes it possible to accomplish at least the following sequences:

- addressing and memorization of the address of the locker reserved by the user
- creation or generation of an alphanumeric control code, memorization of this code and outputting of this control code at the output peripheral
- upon the calling up of an alphanumeric input message at the input peripheral, comparison of the message and the memorized control code; emission of a release-open signal to the external control means of the releasing member of the locker corresponding to the identity between the control code memorized for this locker and the input message.

The use of a cabinet according to the document EP-C-0,065,605 follows from the above description:

- the user stands, with the object to be stored, in front of the deposit cabinet, all the doors of which are closed, the free lockers being indicated by an illuminated individual indicator light, and the occupied lockers by an extinguished individual indicator light
- the user then chooses a free locker by pressing the individual button corresponding to the reserved locker
- from that moment, and after having paid the sum indicated on a display into a coin machine, the centralized system activates the member for releasing open the locking mechanism of the door of the locker reserved
- the user opens the released door of the locker reserved, places his object therein and closes the door which is then automatically fastened shut
- at the same time, the printer supplies him with a ticket indicating, in particular, the control code assigned by the system to the locker reserved
- when the same user returns to the cabinet in order to withdraw the stored object, he punches in the control code on the keyboard; once this code is recognized, the centralized system activates the member for releasing open the locking mechanism of the door of the locker corresponding to the memorized control code, and the system illuminates the corresponding individual indicator light
- the user opens the released door of the locker corresponding to the indicator light thus illuminated, withdraws the deposited object, and closes the door which is automatically fastened shut.

Such a deposit cabinet is relatively complicated to use and its ergonomics are unsatisfactory on several counts. This complexity can be the source, on the one hand, of operational malfunctions of the control system and, on the other hand, of faulty commands by the user. This results, in one way or the other, in the assignment of employees to oversee such cabinets, in particular in order to repair them or to explain to the user how to use them.

These constraints are incompatible with an environment in which personal safety is imperative, for example the use of such cabinets in the banking field, where there is a need to protect oneself against attacks.

Taking just the example of banking establishments, these are increasingly equipped with lock chambers with automatically controlled doors, incorporating a metal detector and operating as follows:

- when a person enters the lock chamber through the outer door, the detector detects any quantity of metal carried by said person, above a preset threshold
- if the detector detects a quantity of metal greater than the preset threshold, the inner door remains locked, whereas it is unlocked for a detection below this threshold
- in the event of the inner door being locked, a synthesized-voice or visual-indication device then invites the person to leave the lock chamber through the outer door and to deposit the detected metal objects outside the lock chamber in a deposit cabinet
- the person enters the lock chamber again, through the outer door, and then leaves through the inner door, into the protected banking area when returning, and upon leaving the lock chamber, the same person recovers the metal objects deposited in the deposit cabinet.

The banking field, to mention only one example, therefore requires deposit cabinets which are practical and simple, prevent the user from being confused about the manipulation or control of the cabinet, and thwart any deliberate and pretended false maneuver by the user, the object being to avoid or eliminate any intervention by the bank staff where the cabinet is sited, outside the safety area.

SUMMARY OF THE INVENTION

The subject of the present invention is therefore a deposit cabinet with a centralized control system, limiting the operational choices of the user as far as possible and simplifying its manipulation.

According to the present invention, in combination:

- a detector of the closed position of the locking mechanism is associated with each locker, and all the detectors of said lockers respectively are incorporated in the centralized control system
- a means for return into the open position is associated or interacts with the door of each locker; this return means is loaded by the closing of the door of the locker by the user, and it acts as soon as the locking mechanism is released open, in order to open the same door completely.

With respect to the execution program loaded on the processor:

- the sequence of addressing and memorizing the address of the locker reserved by the user is activated by the reception of a closed-position signal originating from a detector
- and the sequence of comparing the input message with the control code terminates in the complete and automatic opening of the door of the locker corresponding to the identity between the input message and the control code.

The use of such a cabinet becomes particularly simple:

- the user, standing in front of the cabinet with an object to be deposited, can see directly which lockers are free, from their open doors; he can deposit the object therein directly
- when the user returns to the cabinet, in order to withdraw the deposited object, the system opens automatically the door of the locker corresponding to the control code, which enables the user, on the one hand, to locate his locker immediately and, on the other hand, to withdraw his object directly without needing to close the door of the same locker.

BRIEF DESCRIPTION OF THE DRAWINGS

The present invention is now described, by way of non-limiting example, with reference to the attached drawings, in which.

DESCRIPTION OF THE PREFERRED EMBODIMENT

A cabinet according to the invention has a parallelepipedal general shape and comprises two vertical rows of ten lockers, numbered 1 to 10 for the first row, and 11 to 20 for the second row.

Each locker comprises a closing door 21 bearing, on its outer face, in large letters, the word "occupied", and an individual and reversible locking-up means 22 making it possible to fasten the corresponding door in the closed position, and controlled as described below by the user of said locker.

Figure 2:
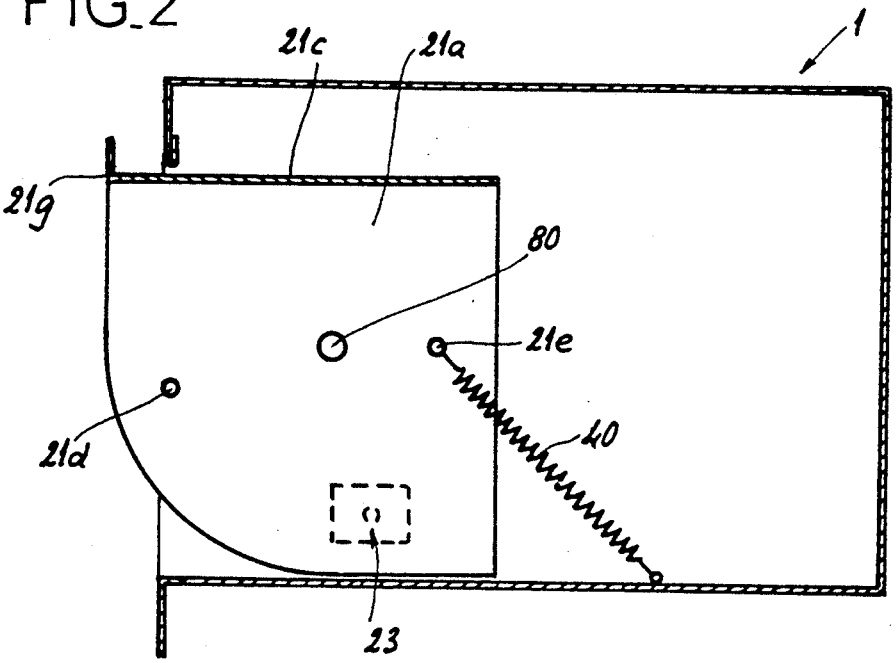
FIGS. 2, 3 and 4 show a given locker, for example locker No. 1, in section along II—II in FIG. 1, respectively in an open position, during closing, and closed
Figure 3:
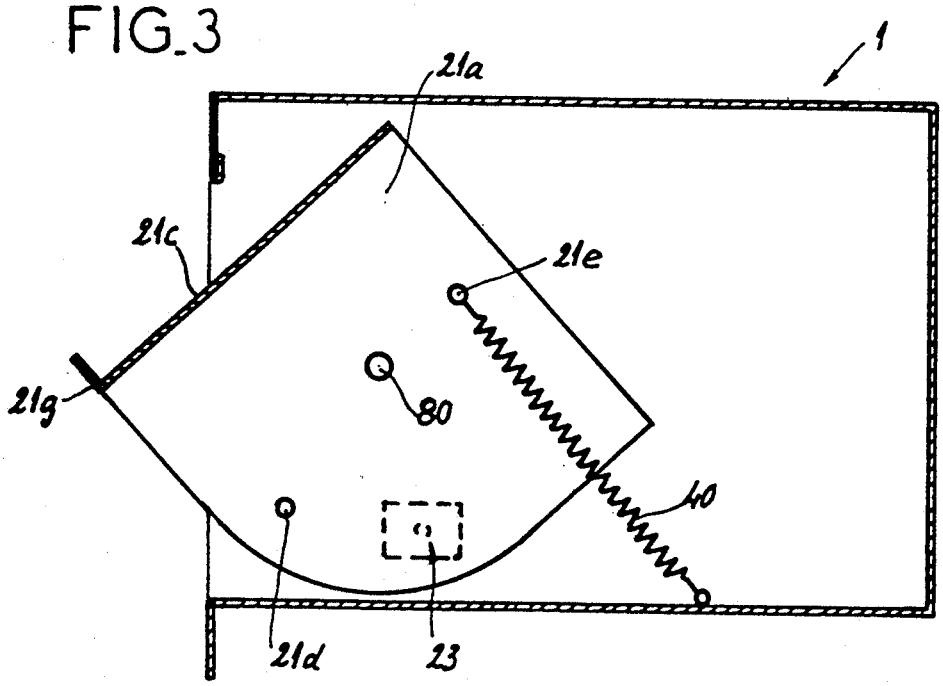
Figure 4:
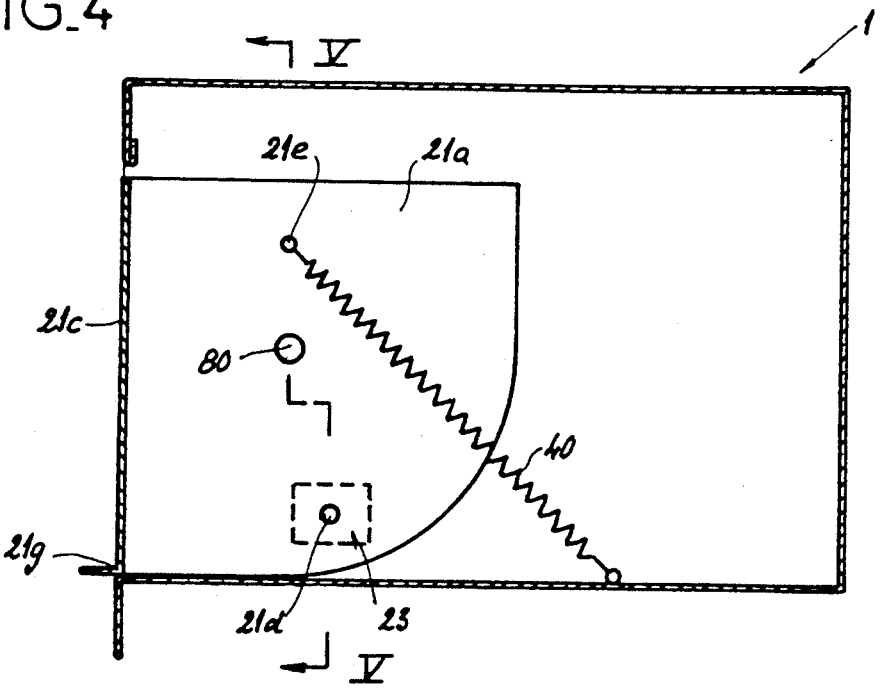

More precisely, as shown in FIGS. 2, 3 and 4, each locking-up means 22 comprises:

- a locking mechanism 23 which is automatically fastened shut, by the closing movement alone, in a downwards direction as described below, of the door 21 of the corresponding locker
- a member 24 for releasing open the locking-up mechanism, with an external electrical control means 25, namely an electromagnet
- a return means or spring 40 returning the door 21 upwards into the completely open position, in other words into the position shown in FIG. 2, with a damping device, not shown
- and a detector 26 for the closed position of the locking mechanism.

More precisely, as shown in FIGS. 2 to 4, the door 21 of each locker comprises two cheeks **21*a* and 21*b* which have a rear contour in an arc of circle and are perpendicular to a central part 21*c* constituting the door proper. The cheeks 21*a* and 21*b* pivot about a common axis of rotation 80 parallel to the plane 21*c* of the door 21. This axis of rotation is arranged with respect to the opening of the locker on the one hand, and to the upper wall of the latter on the other hand, in such a way that the door 21 moves in rotation from a closed position (FIG. 4), in which the door is arranged vertically in the opening of the locker with the outer inscription "occupied", to an open position (cf. FIG. 2), in which the door is arranged horizontally, facing and beneath the upper wall of the locker in question; and the position of the axis of rotation 80 is also chosen in such a way that the door 21 does not project by a large amount from the volume of the corresponding locker with its lower straight edge 21*g* at any moment of its opening or closing, which prevents the system for detecting quantities of metal from being disturbed in the event where the deposit cabinet is situated in the vicinity of an access lock chamber comprising such a detector. Also for the sake of preventing a disturbance of a system for detecting quantities of metal, the door 21** of each locker is made from a non-magnetic material.

The locking mechanism 23 consists, on the one hand, of a hole **21*d* provided on one of the cheeks of the door, for example the cheek 21*a*, and, on the other hand, of a catch bolt 81 pushed towards the cheek 21*a* by a spring 82 arranged on a side wall of the locker 21. This catch bolt 81 is arranged aligned with the hole 21*d* in the closed position of the door 21, and is designed in order to penetrate automatically into said hole under the pressure of the spring 82** in said closed position.

The releasing-open member 24 consists of an electromagnet acting on the tail of the catch bolt 81 and comprising an electrical control means 25. Consequently, when the control means 25 is not supplied electrically, and when the door 21 is closed, the corresponding rest position of the catch bolt 81 locks the door 21 shut. As a safety measure, the tail of the catch bolt can be provided with a manual unlocking ring.

The detector 26 of the closed position of the door consists of a micro-switch which opens or closes an electrical detection circuit arranged at the rear of the electromagnet 24 and actuated by the tail of the catch bolt 81.

The means 40 for return into the open position consists of a spring attached at one end to a fixed stud provided in the wall of the locker and at its other end to a stud 21*e* which can move in rotation, provided on one of the cheeks 21*a* or 21*b*. The rotation of the stud 21*e* is chosen in order to ensure the return of the door 21 into the completely open position by the relaxation of the spring 40.

Figure 1:
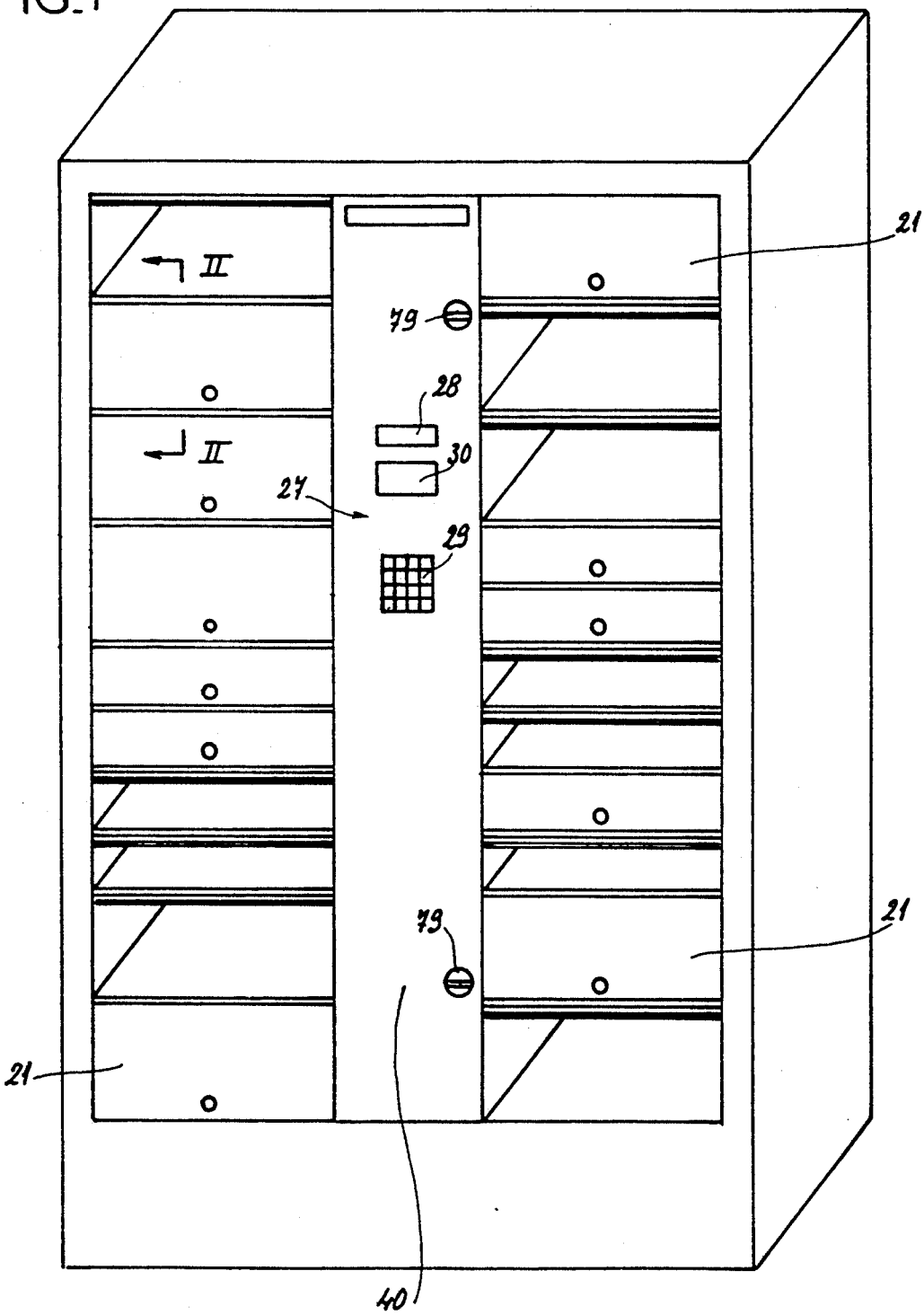
FIG. 1 is a perspective view of a deposit cabinet according to the invention

As shown in FIG. 1, the deposit cabinet according to the invention is provided with a centralized system 27 for controlling the lockers, incorporating, as described below, the various detectors 26 and the various external control means 25 of the members 24 for releasing the lockers 1 to 20 respectively. This centralized system furthermore comprises:

- a printer 28, or output peripheral, for the outputting of a datum of the alphanumeric type, in other words for printing a ticket, and the supplying of the latter to the user, as described below
- a keyboard 29 with 12 or more keys, or input peripheral, for the inputting or calling up of a datum of the alphanumeric type
- a display 30 making it possible to show the data collected at the keyboard 29 or to show the output data of the control system
- a processor, not shown, loaded with various execution programs described below in terms of their general organization and supported by an appropriate memory of the EPROM type, for example.

Figure 5:
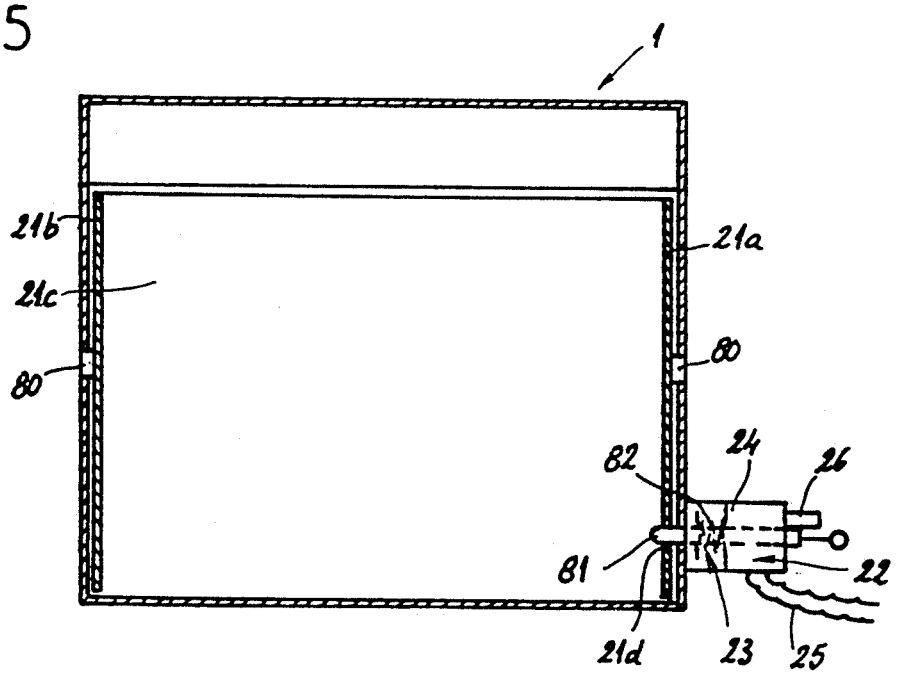
FIG. 5 shows a view in section along V—V in FIG. 4 of the same locker
Figure 6:
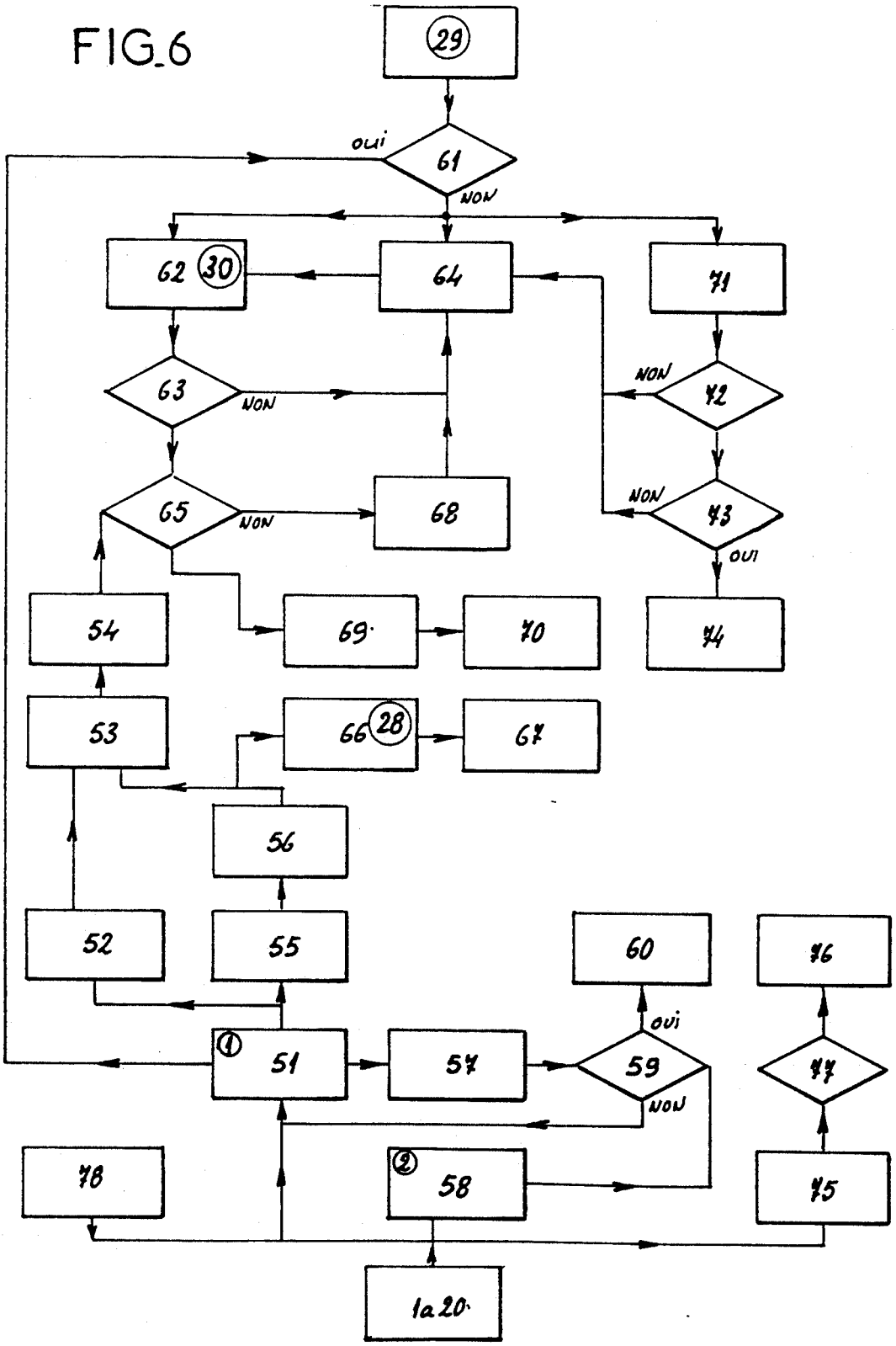
FIG. 6 shows the flowchart of a deposit cabinet according to the invention.

The general flowchart of the control system is shown in FIG. 5 and incorporates a plurality of sequences which will now be described.

A first sequence concerns the controls or instructions executed on the closure of a given locker, for example the locker 1, followed by the possible closure of another locker, for example the locker 2.

When the locker 1 is closed, the corresponding detector 26 sends, by action at 51, a closed-position signal to the control system. From the command 51, firstly the keyboard 29 is locked at 61, secondly the closed locker is addressed at 52, with memorization at 54 of the address in accordance with the writing 53, thirdly a random alphanumeric control code is generated or created, by the advancement at 55 of a random register by one step, the register generated at 56 being memorized at 54 in accordance with the writing 53, and fourthly a time delay, for example of 30 seconds, is triggered at 57. The control code and the address of the locker are printed at 66 with the generation of a ticket 67. After the locker 1 has been closed, at 51, a following locker, for example 2, can be fastened shut at 58 only after the time lapse of 30 seconds, for example, failing which, a releasing-open signal 60 is emitted by the control 59 to the external control means 25 of the member for releasing the locker 2.

A second sequence concerns the commands or instructions executed by the user, at the keyboard 29, permitting the unlocking and the reopening of a given locker. The user calls up, on the keyboard 29, firstly the number of the locker used and then an alphanumeric input message written on the ticket printed at 67. The number of the locker and the input message which are called up on the keyboard 29 are displayed at 62 on the display or screen 30. The alphanumeric message is firstly checked at 63 for its conformity, a message which does not conform controlling at 64 a resetting of the display 30. The alphanumeric message is then compared at 65 with the alphanumeric code memorized at 54, for the address of the locker called up by the user. Where the input message and the control code are identical for the locker called up by the user, the address of the latter is decoded at 69 and a releasing-open signal 70 is emitted towards the external control means 25 of the member for releasing the identified locker. If the user repeatedly calls up the wrong data, an appropriate signal can be controlled at 68.

The flowchart in FIG. 5 of the control system also comprises several sequences which are accessible only to the owner of the deposit cabinet.

One of the sequences, an initialization sequence, is accessible to the owner by entering at 71, using the keyboard 29, an initialization message, by checking this message for its conformity at 72, a code which does not conform generating at 64 a resetting of the display 30, by comparing at 73 the initialization message with a preexisting memorized code, and by emitting at 74 a releasing-open signal to the various lockers which can open simultaneously or successively.

The same flowchart also comprises a deactivation sequence which is accessible only to the owner and according to which, after the doors of all the lockers have been fastened shut at 75, and successively taking into account the time delay 57/59, but without the creation of the control codes at 55/56, all the members 24 for releasing the various lockers are deactivated, the latter then remaining in the locked position. This deactivation at 76 takes place after a time check at 77 in order to take into account the abovementioned time delay.

The same flowchart can be associated with a remote-control means 78 of the member 24 for releasing one or more permanently closed lockers, this remote control taking place in parallel with the control of these same lockers under the control of the processor.

The above-described cabinet can also comprise a central technical cover 40 which is accessible only to the owner by way of two locks 79 and by means of which the locking mechanisms 23 of all the lockers can be released manually in the event of a malfunction.

Lastly, and also only for the owner, the cabinet can comprise a visualization device at a distance from or to one side of the open and closed lockers, and an alarm for signaling the end of the paper strip of the printer 28.

A cabinet as described above then functions as follows:

- the user introduces the object to be deposited into an open locker of a suitable size and volume for the abovementioned object, and then he closes the locker by pivoting the door 21; this closed door allows the outer inscription "occupied" to be particularly visible
- the door closed in the above manner remains locked under the action of the corresponding locking mechanism 23
- once this locking shut has been detected, the control system 27 automatically prints and supplies a precut ticket bearing the number of the locker, the control code and possibly the day and time of deposit in order to withdraw the deposited object from the abovementioned locker, the user punches into the keyboard 29 the control code shown on his ticket after having introduced, also using the keyboard 29, the locker number shown on his ticket or memorized if the code number is correct, the number for releasing open the locker is controlled, which releases the locking mechanism 23 and causes the complete opening of the door 21, by virtue of its means for return to the open position.

The above-described apparatus has the following advantages.

The choice of an empty locker can be made simply at a glance:

the closed lockers are occupied and the word "occupied" visible on the outside of the door acts as a visual aid;

the open lockers are available to users, the latter then choosing the reserved locker according to the size of the object to be deposited.

The opening/closing movement of a locker door in a quarter of a circle makes it possible:

to reduce the overall size of the deposit cabinet, the doors moving inside the apparatus; such an advantage is important when the deposit cabinet is arranged in a pre-lock chamber;

to avoid any interference of the metal detector since the movement of the door takes place within the metal structure of the cabinet which forms a cage.

The lockers do not have any key-operated mechanical lock.

In the event of a breakdown of the control system 27, the owner can carry out maintenance on the cabinet by unlocking the technical cover 40, giving access to the locking mechanism of the various lockers.

By controlling the releasing-open members 24, the doors of unlocked lockers return automatically to the open position, via the return means or an equivalent compensating device.

Using a programmable code available to the owner, the latter can either close all the doors of the lockers, without supplying a ticket, or unlock all these doors in order to check visually that no object has been left therein.

By virtue of the time delay separating the successive closing of two lockers, an attacker is prevented from closing deliberately, and virtually simultaneously, all the doors in order to force the owner to leave his safety area.

By virtue of the lockers which are permanently closed and can be unlocked from a distance by the owner, the latter can thwart the actions of any attacker faking incomprehension of how the deposit cabinet works.

A deposit cabinet according to the invention can, of course, and as has already been said, have other applications, for example in public places.

We claim:

1. A deposit cabinet, comprising:

a plurality of lockers, each locker comprising a closing door and a locking mechanism for the door whereby said door is automatically locked shut by a closing movement of said door;

a member for releasing said locking mechanism;

a detector for detecting an open position and a closed position of the door;

external electrical control means for a centralized control system for said lockers, comprising:

an output device for outputting a datum of the alphanumeric type;

an input device for inputting a datum of alphanumeric type;

a processor for controlling said locker door position including:

means for activating said processor responsive to a locker door being put in a closed position;

means for addressing and memorizing an address of a locker upon closing of a door of said locker, means for creation and memorization of an alphanumeric control code, means for outputting the control code at the output device, means for comparing a message with the control code, means for emitting a releasing signal to the external control means of the releasing member, when the input message matches the control code, means for returning the door to an open position and deactivating said processor when said releasing signal is emitted.

2. The cabinet as claimed in claim 1, wherein each locker further comprises:

an opening and closing means for the door, enabling it to move from a closed position, in which the door is arranged vertically, to an open position, in which the door is arranged horizontally, facing underneath an upper wall of the locker.

3. The cabinet as claimed in claim 2, wherein:

said door is arranged such that the lower edge of the door does not project substantially outward from a volume of the locker when it moves from the open position to the closed position or from the closed position to the open position.

4. The cabinet as claimed in claim 1, wherein the door of each said locker is made from a non-magnetic material.

5. The cabinet as claimed in claim 2, further comprising:

a time-delay means for allowing closure of a subsequent locker only after a predetermined lapse of time.

6. The cabinet as claimed in claim 1, further comprising a second control means at a distance from the releasing member of at least one closed locker, in parallel with the control means under the control of said processor.

* * * * *